US007993610B2

(12) United States Patent
Rich

(10) Patent No.: US 7,993,610 B2
(45) Date of Patent: Aug. 9, 2011

(54) BLOOD CENTRIFUGE ROTOR WITH FILL INDICATOR

(75) Inventor: Carl Russell Rich, Falmouth, ME (US)

(73) Assignee: IDEXX Laboratories, Incorporated, Westbrook, ME (US)

( * ) Notice: Subject to any disclaimer, the term of this patent is extended or adjusted under 35 U.S.C. 154(b) by 1273 days.

(21) Appl. No.: 11/541,910

(22) Filed: Oct. 2, 2006

(65) Prior Publication Data

US 2007/0077183 A1 Apr. 5, 2007

Related U.S. Application Data

(60) Provisional application No. 60/723,884, filed on Oct. 5, 2005.

(51) Int. Cl.
*B04B 1/00* (2006.01)

(52) U.S. Cl. ..... 422/548; 422/72; 422/73; 422/547; 422/549; 422/550

(58) Field of Classification Search ..... 422/72, 422/73, 102, 104, 547, 548, 549, 550; 494/10, 494/31–34, 41, 43
See application file for complete search history.

(56) References Cited

U.S. PATENT DOCUMENTS

| | | | | |
|---|---|---|---|---|
| 4,308,232 | A | 12/1981 | Crouther et al. | 422/102 |
| 4,604,086 | A | 8/1986 | Benko et al. | 494/16 |
| 4,675,159 | A | 6/1987 | Al-Sioufi | 422/36 |
| 4,846,974 | A | 7/1989 | Kelley et al. | 210/380.1 |
| 4,981,585 | A | 1/1991 | Kelley et al. | 210/138 |
| 5,077,194 | A | 12/1991 | Heeny et al. | 435/5 |
| 5,269,443 | A | 12/1993 | Lancaster | 222/207 |
| 6,793,892 | B1 | 9/2004 | Niermann | 422/101 |
| 7,169,602 | B2 * | 1/2007 | Sandell | 435/288.4 |
| 2004/0002165 | A1 | 1/2004 | Buchanan et al. | 436/180 |
| 2005/0244843 | A1 | 11/2005 | Chen et al. | 435/6 |

FOREIGN PATENT DOCUMENTS

| | | |
|---|---|---|
| EP | 0609794 | 8/1994 |
| EP | 0766973 | 4/1997 |

* cited by examiner

*Primary Examiner* — Jill Warden
*Assistant Examiner* — Dwayne K Handy
(74) *Attorney, Agent, or Firm* — Gerald T. Bodner

(57) ABSTRACT

A spinnable rotor for a high speed centrifuge includes a housing which defines a chamber interiorly thereof for receiving a whole blood sample and for containing a predetermined amount of red blood cell absorbent gel. The housing includes an upper portion and a bottom portion, the upper portion having a port formed through the thickness thereof. The upper portion has at least a portion thereof formed from a light transmissible material. A light pipe is joined to the upper portion and light transmissively communicates with the light transmissive portion of the upper portion. The light pipe extends at least partially into the chamber and has an open, lower free end. When whole blood filling the rotor chamber contacts the lower free end of the light pipe, the red color of the blood is transmissively communicated to the upper portion of the rotor housing where it is viewable by the user of the centrifuge.

8 Claims, 3 Drawing Sheets

BLOOD CENTRIFUGE ROTOR WITH FILL INDICATOR

CROSS REFERENCE TO RELATED APPLICATION

This application is related to U.S. Provisional Application Ser. No. 60/723,884 filed on Oct. 5, 2005, and entitled "Blood Centrifuge Rotor with Fill Indicator", the disclosure of which is incorporated herein by reference and on which priority is hereby claimed.

BACKGROUND OF THE INVENTION

1. Field of the Invention

This invention relates to blood separation devices, and more particularly relates to blood centrifuges having a spun rotor. Even more specifically, this invention relates to rotors for high speed blood centrifuges.

2. Description of the Prior Art

FIGS. 1, 1A, 2 and 3 are various views of a hematocrit rotor 2 used in a high speed spinning centrifuge used primarily for in vitro diagnostics and incorporated in the VetTest™ veterinary blood analyzer manufactured and sold by Idexx Laboratories, Inc. of Westbrook, Me.

The rotor 2 is generally cylindrical in its overall outer shape, and includes a housing having 3 an upper portion 4 joined to a lower portion 6. The upper portion 4 and lower portion 6 define between them an interior chamber 8 or well for receiving a sample of whole blood. For this purpose, the upper portion 4 is provided with a central fill port 10 communicating with the interior chamber 8 so that a user may supply a blood sample from a pipette through the port 10 and into the chamber 8 prior to centrifugation and, conversely, withdraw plasma collected in the chamber 8 after blood separation has been completed.

The rotor 2 includes a silicone gel 12 situated circumferentially about the interior chamber 8 above the lower portion 6, which gel 12 captures or absorbs the denser blood cells from the sample, but not the plasma, when the rotor 2 is spun at high speeds. After centrifugation, the plasma collects in the lower portion 6 of the rotor 2 where it may be retrieved through the port 10 in the upper portion 4 by using a pipette.

A problem arises with the rotor described above in that it may be overfilled with the whole blood sample. The amount of gel 12 provided about the interior of the rotor 2 can only absorb a certain quantity of blood cells for a given volume of blood sample. Accordingly, if the rotor chamber 8 is overfilled, the whole blood sample may exceed the capacity of the gel to absorb the denser cells. Thus, not all of the blood cells will be absorbed by the gel 12 upon centrifugation, resulting in blood cells remaining in the plasma. This may affect the accuracy of subsequent diagnostic tests and especially colorimetric measurements performed on the plasma and provide uncertain and possibly inaccurate analytical results.

Although instructions are provided with the VetTest™ analyzer on the proper use of the centrifuge and the correct volume of whole blood sample with which to fill the rotor, the clinician or user may unknowingly overfill the rotor with whole blood, resulting in an unseparated blood cell component remaining in the plasma after centrifugation.

OBJECTS AND SUMMARY OF THE INVENTION

It is an object of the present invention to provide a rotor for a blood centrifuge which includes an indicator that alerts the user that the rotor is filled to the proper level with whole blood.

It is another object of the present invention to provide a rotor for a centrifuge which prevents the rotor from being overfilled with whole blood.

It is a further object of the present invention to provide a blood centrifuge and improved rotor therefor which overcomes the disadvantages of conventional blood centrifuges.

In accordance with one form of the present invention, a rotor for a blood centrifuge includes a housing defining a chamber interiorly thereof for receiving a whole blood sample. The housing also contains a predetermined amount of a red blood cell absorbent gel. The housing includes an upper portion having a top wall and a lower portion having a bottom wall opposite the top wall. The top wall has a port formed through the thickness thereof. The port is in fluid communication with the interior chamber. The top wall preferably has at least a portion thereof formed from a light transmissible material, such as a clear or translucent plastic material.

The rotor further includes a light pipe joined to the top wall and light transmissively communicating with the light transmissive portion of the top wall. The light pipe extends at least partially into the chamber.

The light pipe includes a lower free end which is spaced from the bottom wall a predetermined distance so that when a predetermined optimum volume of whole blood is received by the rotor chamber, the lower free end of the light pipe will contact the whole blood, causing the red color of the whole blood to be transmissively communicated through the light pipe to the top wall of the housing where it is viewable by a user of the blood centrifuge. Accordingly, the top wall of the centrifuge rotor or at least a portion of the top wall turns red as an indication of the proper volume of the whole blood received by the rotor chamber for centrifugation.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

The present invention is an improvement over the conventional rotor 2 used in high speed spinning blood centrifuges. The rotor 20 of the present invention provides an indication to the user when the rotor has been filled to an optimum level of whole blood. The rotor 20 also minimizes the chance that blood may spill from the filled rotor if the rotor is inadvertently inverted. Also, the structure of the rotor 20 of the present invention helps force the whole blood outwardly to the peripherally situated gel 12 during centrifugation rather than back up through the fill port 10.

Figure 1:
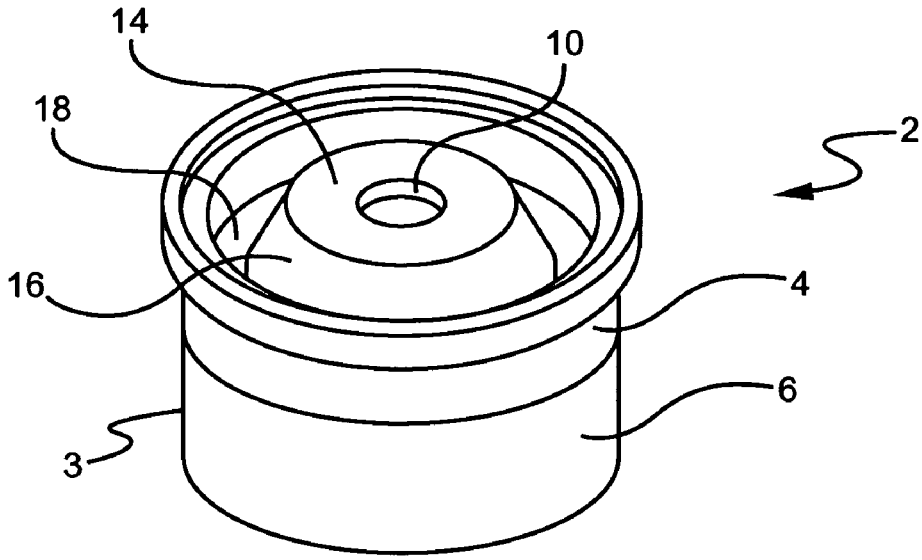
FIG. 1(Prior Art)
FIG. 1 is a perspective view of a conventional rotor for use with a high spin rate blood centrifuge.
Figure 1A:
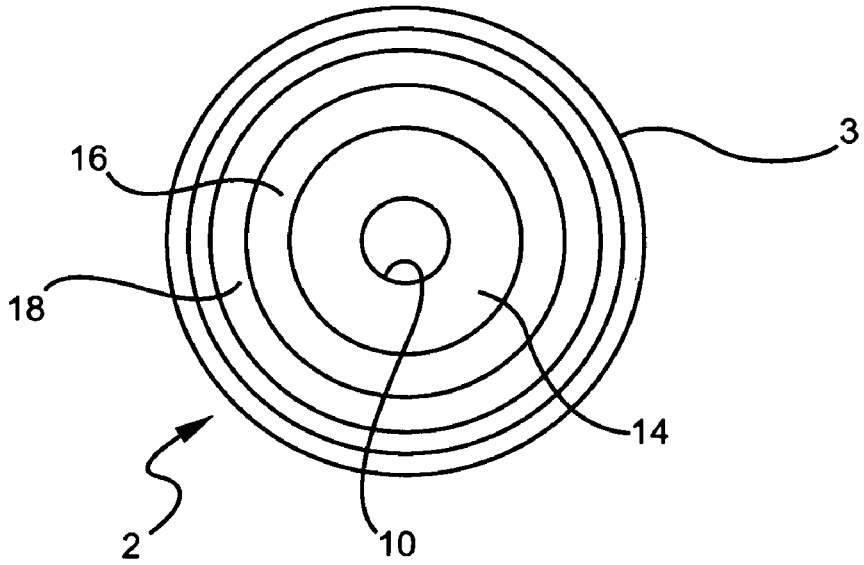
FIG. 1A(Prior Art)
FIG. 1A is a top plan view of the conventional rotor shown in FIG. 1.
Figure 2:
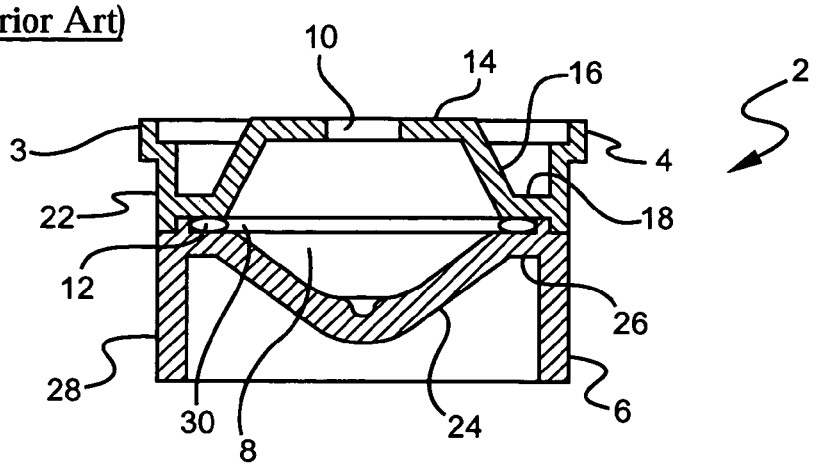
FIG. 2(Prior Art)
FIG. 2 is a cross sectional view taken along line 2-2 of the conventional centrifuge rotor shown in FIG. 1.
Figure 3:
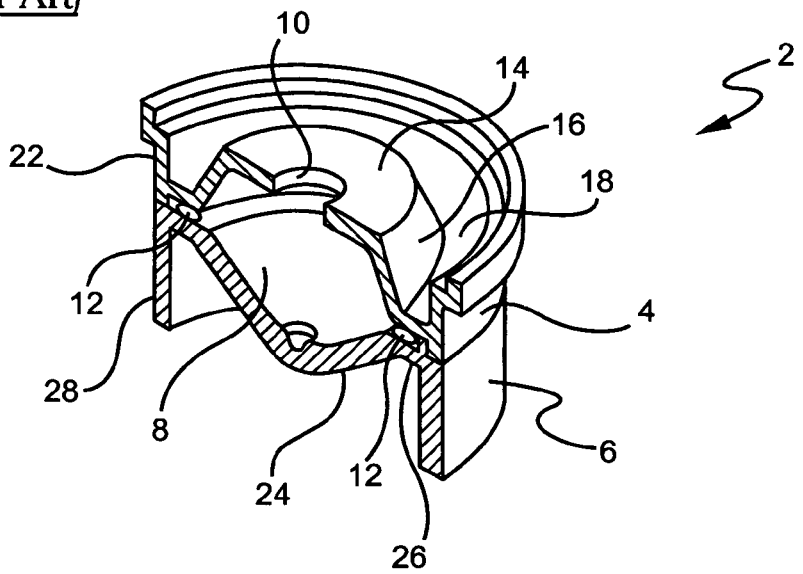
FIG. 3(Prior Art)
FIG. 3 is a perspective view of the cross section portion of the conventional rotor shown in FIG. 2.

The conventional rotor 2 is shown in FIGS. 1-3. Preferably, but not necessarily, the rotor 20 of the present invention, shown in FIGS. 4-6, includes certain structure which is similar to that of the conventional rotor 2. Accordingly, it should be noted that like structure found in the conventional rotor 2 and in the preferred form of the present invention is indicated by like reference numerals.

Figure 4:
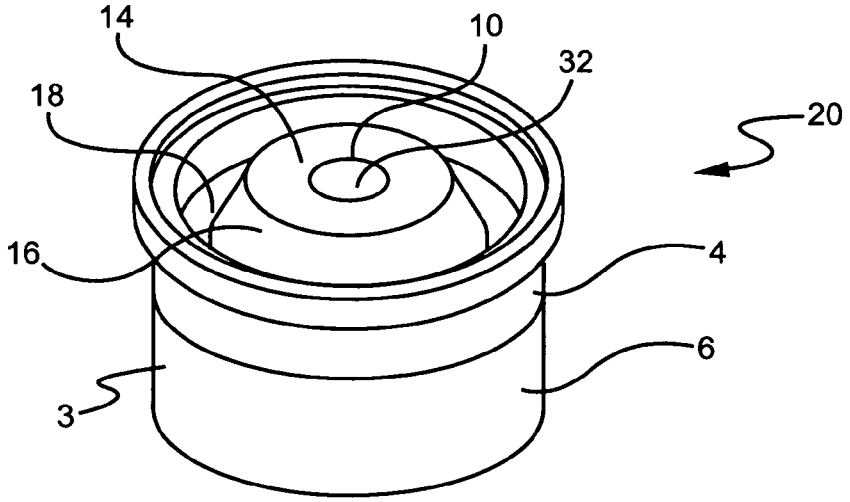
FIG. 4 is a perspective view of an improved centrifuge rotor formed in accordance with one form of the present invention.
Figure 5:
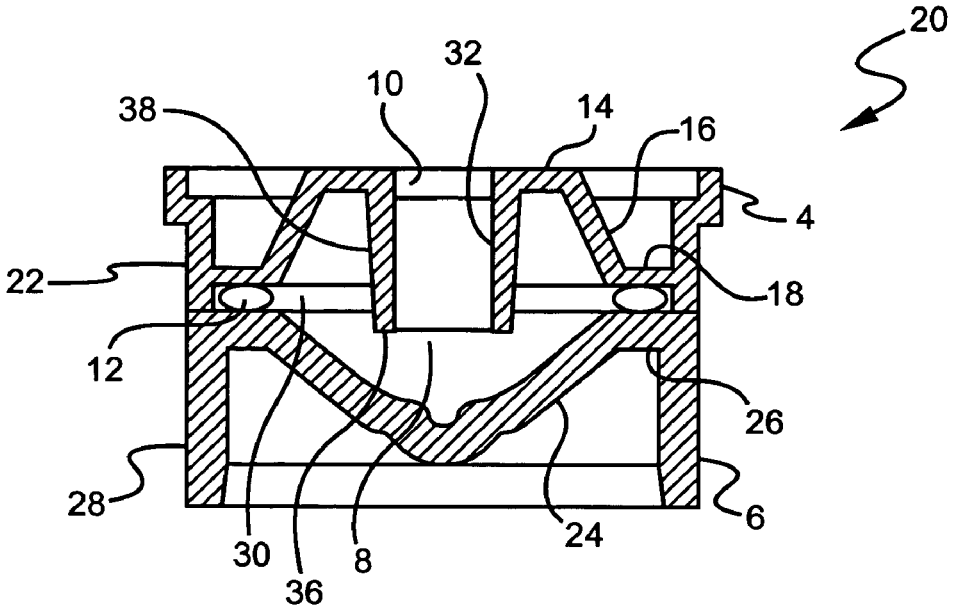
FIG. 5 is a cross sectional view of the rotor of the present invention, taken along line 5-5 of FIG. 4.
Figure 6:
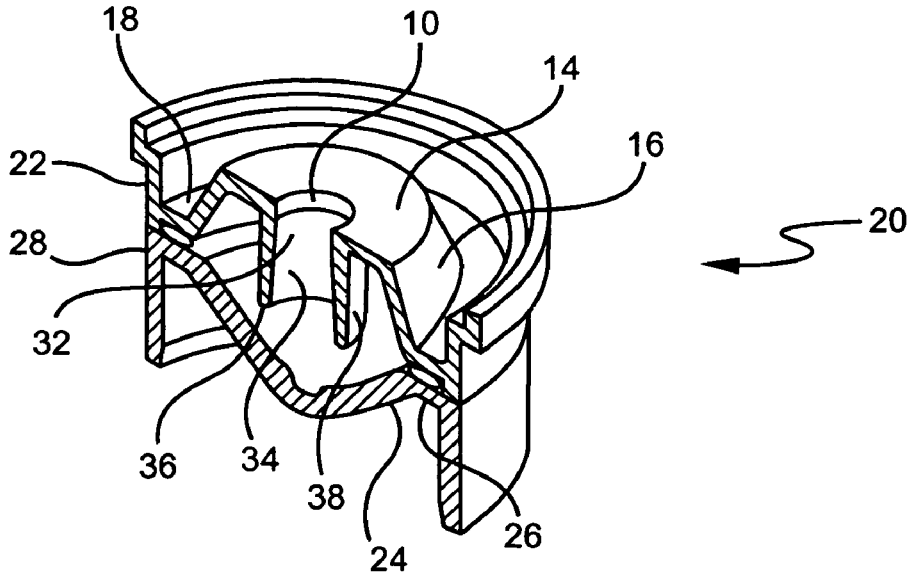
FIG. 6 is a perspective view of the cross section portion of the rotor of the present invention shown in FIG. 5.

Referring to FIGS. 4-6 of the drawings, it will be seen that a rotor 20 for a high speed centrifuge formed in accordance with the present invention includes a housing 3 which preferably is formed from an upper portion 4 and a lower portion 6 that are joined together. The upper portion 4 and lower portion 6 of the housing 3 together define an interior chamber for receiving a whole blood sample and, as will be explained in greater detail, for containing a predetermined amount of a red blood cell absorbent gel 12.

More specifically, the upper portion 4 includes a top wall 14, which top wall 14 may further include a sloping side wall 16 which extends into a radially extending peripheral wall 18 that is joined to a generally cylindrically-shaped outer wall 22. The top wall 14 of the upper portion 4 includes a fill port 10 formed through the thickness thereof for adding whole blood to the rotor chamber 8 and extracting plasma after the whole blood is centrifuged. The fill port 8 communicates through the top wall 14 with the interior chamber 8 of the rotor 20.

The lower portion 6 of the housing 3 includes a generally conically-shaped bottom wall 24 which extends to a radially extending peripheral wall 26 which, in turn, is joined to a generally cylindrically-shaped outer wall 28. The cylindrical outer wall 22 of the upper portion 4 rests atop the cylindrical outer wall 28 of the lower portion 6 and both have preferably the same diameter. The radially extending peripheral wall 18 of the upper portion 4 overlies the radially extending peripheral wall 26 of the lower portion 6 and is spaced apart therefrom to define a gap 30 therebetween, which gap 30 receives and holds in place a predetermined amount of red blood cell absorbent gel 12, which is preferably a silicone gel.

Both the conventional rotor 2 and the improved rotor 20 of the present invention operate in the manner described below. The user of the centrifuge pipettes a predetermined volume of whole blood into the interior chamber 8 of the rotor 2, 20 through the fill port 8. The rotor 2, 20 is then placed on the centrifuge and spun at a high speed. The denser red blood cells are caused by centripetal force to contact and be absorbed by the gel 12 during centrifugation, but the blood plasma is not absorbed. After a predetermined period of time, centrifugation is stopped, and the blood plasma settles to the cone-shaped lower portion 6 of the housing 3 within the interior chamber 8. The red blood cells remain absorbed in the gel 12. The user then extracts, with a pipette, the plasma from the interior chamber 8 of the rotor for diagnostic testing.

One of the problems with the conventional rotor 2 shown in FIGS. 1-3 is that the user may unknowingly or inadvertently overfill the interior chamber 7 of the rotor. Only a certain amount of absorbent gel 12 is provided in the rotor 2, but that amount is usually sufficient to completely separate the red blood cells and the plasma for a given volume of whole blood. However, if the rotor 2 is overfilled, then the whole blood sample may exceed the capacity of the gel 12 to absorb the denser cells. Thus, it is possible that not all of the red blood cells will be absorbed by the gel, resulting in blood cells remaining in the plasma. When diagnostic tests, especially calorimetric measurements, are performed on the plasma which contain unabsorbed red blood cells, the measurements and resulting analysis may be in error.

The rotor 20 of the present invention, shown in FIGS. 4-6, is provided to address the problem of overfilling the interior chamber 8 with more than the preferred volume of whole blood, which is approximately 600 microliters. Preferably, the rotor 20 includes a light pipe 32 which is integrally formed as part of the upper portion 4 of the housing 3 and is joined to the top wall 14 thereof. The light pipe 32 extends at least partially into the chamber 8, and is formed of a light transmissible material, such as a transparent or translucent plastic material. Preferably, at least a portion of the top wall 14 of the upper portion 4 is formed from a light transmissible material, such as a transparent or translucent plastic material. Alternatively, the entire rotor housing 3 may be formed from a light transmissible material.

Even more specifically, the light pipe 32 is in the form of a cylindrical tube which surrounds the fill port 10 formed in the top wall 14 and extends therefrom at least partially into the rotor chamber 8. The cylindrical tube of the light pipe 32 defines an axial bore 34 which is in fluid communication with the fill port 10 and the chamber 8. The light pipe 32 has an open, lower free end 36 which is spaced apart from the bottom wall 24 of the housing a predetermined distance so that when a predetermined volume of whole blood is received by the rotor chamber 8, the lower free end 36 of the light pipe will contact the whole blood, causing the red color of the whole blood to be transmissively communicated through the light pipe 32 to the top wall 14 of the housing 3 and viewable thereat as an indication of the proper volume and level of the whole blood received by the rotor chamber 8.

Accordingly, if the user inadvertently or unknowingly begins to overfill the rotor chamber 8, the whole blood will contact the lower free end 36 of the light pipe 32, and the top wall 14 of the housing 3 will turn a red color, to indicate that the rotor is filled at the optimum level with whole blood.

The cylindrically-shaped light pipe 32 also serves another purpose. By having the light pipe extend a predetermined distance into the chamber 8 from the top wall 14 of the housing 3, an excessive volume of whole blood greater than the recommended volume of whole blood received by the chamber 8 will begin to at least partially fill the bore 34 of the light pipe 32 and prevent the chamber 8 from being overfilled with whole blood. In other words, once the whole blood has reached the optimum level in the rotor chamber 8, where the surface of the whole blood contacts the free end 36 of the light pipe, adding more whole blood will just fill the axial bore 34 of the light pipe and not the rest of the chamber 8, forcing the user to stop pipetting more whole blood into the rotor 20. The volume of the axial bore 34 of the preferably cylindrically-shaped light pipe 32, in combination with the optimum (recommended) volume of whole blood partially filling the chamber 8, is such that the predetermined amount of red blood cell absorbent gel 12 contained in the rotor 20 is still capable of absorbing all of the red blood cells from the whole blood equaling these combined volumes. Accordingly, the rotor chamber 8 can never be overfilled beyond a certain volume of whole blood for which the gel 12 would be incapable of absorbing all of the red blood cells therefrom.

The preferred cylindrically-shaped light pipe 32 of the rotor 20 of the present invention includes an outer cylindrical wall 38 which is sloped radially outwardly from the top wall fill port 10 to the free end 36 thereof. Stated another way, the radius of the light pipe 32 at the fill port 10 is less than that at the opening in the lower free end 36 of the light pipe. With the conventional rotor 2 shown in FIGS. 1-3, it is possible that an overfilled rotor may cause some blood to be ejected through the fill port 10 during centrifugation. The rotor 20 of the present invention, with a light pipe 32 thus formed, minimizes the chance of this occurring. Since the cylindrical outer wall 38 of the light pipe 32 increasingly slopes radially outwardly toward the free end 36 thereof, during centrifugation, the whole blood is caused by centripetal force to travel along the surface thereof from the open free end 36 of the light pipe 32 to where the light pipe is joined to the top wall 14, then along the interior surface of the top wall, that of the sloping side wall 16 and toward the radially extending peripheral wall 18 where the red blood cell absorbent gel 12 is located.

Furthermore, by adding the inwardly extending light pipe 32 surrounding the fill port 10 to the rotor 20 of the present invention, there is less chance that whole blood may spill from the rotor through the fill port 10 if the rotor is inadvertently placed on its side or inverted. The whole blood will flow from the lower portion 6 to the upper portion 4 and fill the space between the outer cylindrical wall 38 of the light pipe 32 and the walls of the upper portion 4, as the level of whole blood in an inverted rotor should not exceed the height of the free end 36 of the light pipe 32 above the top wall 14.

As can be seen from the foregoing description, the rotor 20 of the present invention provides a visual indication to the clinician or user of the centrifuge of the optimum fill level of the whole blood being pipetted into the rotor chamber 8. The structure of the rotor 20 of the present invention, with its cylindrically-shaped light pipe 32 extending into the interior chamber 8 of the rotor, also prevents the rotor from being overfilled to such an extent that the absorbent gel 12 is incapable of fully separating the red blood cells from the whole blood. Furthermore, the structure of the rotor 20 of the present invention minimizes the chance that whole blood may spill out of the fill port 10 if the rotor is inadvertently inverted.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A rotor for a blood centrifuge, which comprises:

a housing defining a chamber interiorly thereof for receiving a whole blood sample and for containing a predetermined amount of red blood cell absorbent gel, the housing including an upper portion and a lower portion opposite the upper portion, the upper portion having a port formed through the thickness thereof, the port being in fluid communication with the chamber; and a light pipe joined to the upper portion and light transmissively communicating with the upper portion, the light pipe extending at least partially into the chamber;

wherein the light pipe extends partially into the chamber and includes a lower free end which is spaced from the lower portion of the housing a predetermined distance so that when a predetermined volume of whole blood is received by the rotor chamber, the lower free end of the light pipe will contact the whole blood, causing the color of the whole blood to be transmissively communicated through the light pipe to the upper portion of the housing and viewable thereat as an indication of the proper volume of the whole blood received by the rotor chamber; and wherein the light pipe is in the form of a cylindrical tube surrounding the port formed in the upper portion and extending therefrom at least partially into the rotor chamber, the cylindrical tube having formed therein an axial bore which is in fluid communication with the port and the chamber.

2. A rotor as defined by claim 1, wherein the light pipe includes an outer cylindrical wall, the outer cylindrical wall being sloped radially outwardly in a direction from the upper portion fill port to the free end thereof.

3. A rotor as defined by claim 1, wherein the light pipe extends a predetermined distance into the chamber from the upper portion of the housing so that a volume of whole blood greater than the predetermined volume of whole blood received by the chamber will at least partially fill the bore of the light pipe to prevent the chamber from being overfilled with whole blood.

4. A rotor as defined by claim 3, wherein the volume of whole blood at least partially filling the light pipe bore and the predetermined volume of whole blood at least partially filling the chamber is at most equal to a volume of whole blood for which the amount of gel contained in the chamber is capable of absorbing the red blood cells therefrom upon centrifugation.

5. A rotor for a blood centrifuge, which comprises:

a housing defining a chamber interiorly thereof for receiving a whole blood sample and for containing a predetermined amount of red blood cell absorbent gel, the housing including an upper portion and a lower portion opposite the upper portion, the upper portion having a port formed through the thickness thereof, the port being in fluid communication with the chamber; and a cylindrical tube surrounding the port formed in the upper portion of the housing and extending therefrom at least partially into the rotor chamber, the cylindrical tube having formed therein an axial bore which is in fluid communication with the port and the chamber, the cylindrical tube including a lower free end which is spaced from the lower portion of the housing a predetermined distance so that when a predetermined volume of whole blood is received by the rotor chamber, the lower free end of the cylindrical tube will contact the whole blood.

6. A rotor as defined by claim 5, wherein the cylindrical tube includes an outer cylindrical wall, the outer cylindrical wall being sloped radially outwardly in a direction from the upper portion fill port to the free end thereof.

7. A rotor as defined by claim 5, wherein the cylindrical tube extends a predetermined distance into the chamber from the upper portion of the housing so that a volume of whole blood greater than the predetermined volume of whole blood received by the chamber will at least partially fill the bore of the cylindrical tube to prevent the chamber from being overfilled with whole blood.

8. A rotor as defined by claim 7, wherein the volume of whole blood at least partially filling the bore of the cylindrical tube and the predetermined volume of whole blood at least partially filling the chamber is at most equal to a volume of whole blood for which the amount of gel contained in the chamber is capable of absorbing the red blood cells therefrom upon centrifugation.

* * * * *